United States Patent [19]

Nasu

[11] Patent Number: 4,771,986

[45] Date of Patent: Sep. 20, 1988

[54] JACK OF A PANTOGRAPH TYPE (II)

[75] Inventor: Hayato Nasu, Kyoto, Japan

[73] Assignee: Michael Hung, Taipei, Taiwan

[21] Appl. No.: 27,624

[22] Filed: Mar. 19, 1987

[51] Int. Cl.[4] ..... B66F 3/08

[52] U.S. Cl. ..... 254/126

[58] Field of Search ..... 254/126, 122, 8 B, 9 B, 254/10 B; 403/154, 161, 163

[56] References Cited

U.S. PATENT DOCUMENTS

| | | | |
|---|---|---|---|
| 2,260,048 | 10/1941 | Newell | 403/161 |
| 3,164,054 | 1/1965 | Biesecker | 403/163 |
| 3,231,300 | 1/1966 | Moroney | 403/163 |
| 4,382,744 | 5/1983 | Klem et al. | 403/154 |
| 4,583,713 | 4/1986 | Fukura et al. | 254/126 |
| 4,586,696 | 5/1986 | Mugford et al. | 254/126 |

*Primary Examiner*—Robert C. Watson

*Attorney, Agent, or Firm*—Ladas & Parry

[57] ABSTRACT

This invention relates to a jack of a pantograph type, especially to the improvement of pivot joint mechanism of jack comprising screw nut body engaged with screw, metal body having screw bearing hole and end portions of a pair of upper and lower grooved links, and constituted by combining the upper and the lower grooved links with the screw block in which the screw block having unidiameter passes through an inserting hole formed on two side wall portions of end portions of the upper and lower grooved links to extend the two end portions of screw block for projecting outwardly. In this state, a plurality of projections for stopping are formed by plastic working with separating each other around axial periphery on the portions of screw block adjacent to inner and outer face of two side wall portions of the upper and lower grooved links respectively.

5 Claims, 1 Drawing Sheet

JACK OF A PANTOGRAPH TYPE (II)

This invention relates to a jack of a pantograph type, especially to the improvement of combining mechanism, pivot joint mechanism, of a screw block which has a screw engaged hold to engage with thread portion or axial portion of screw in its central portion of axial direction, in other words, a screw nut body which has screw engaged thread hole or a metal which has screw bearing hole, with the end portions of a pair of grooved links.

Such combining mechanism has been disclosed in, for example, Japanese Patent Laid Open No. 55-46718 in which the three stage diameter structure of head and large diameter axial portion having screw engaged hole and small diameter prior end portion constitute screw block. On the other hand, axial portion engaged hole is placed in one of the side wall portion of end portion of the upper and lower grooved link and the prior end portion engaged hole or the axial portion engaged hole is placed in the other side wall portion so as to pass the screw block through the axial portion engaged hole and prior end portion engaged hole of grooved links and then extend to outside of two side walls. Hence, flange stopper is formed by plastic working on the end portion of prior end portion so as to combine the two side wall portions of end portions of the upper and lower grooved links with the screw block in which the two side wall portion can pivotally moved in the large diameter axial portion and the small diameter prior end portion of screw block and it is known.

Although the main object of prior combining mechanism as described above is to reduce the manufacturing cost and increase the strength, due to the screw blcok is of a structure of use three stage diameter, the object of reducing manufacturing cost is therefore hardly achieved, at the same time, in order to ensure the strength of the small diameter prior end portion, it must be manufactured from rod having big section, hence, it is hardly to reduce the material cost and the weight. In addition, since at least one of the inner side of the side wall portion of grooved links can move toward any direction, it is easily moved inwardly, therefore, the problem of less stability is existed.

SUMMARY OF THE INVENTION

In accordance with the present invention, the problems as described above can easily resolved by present invention jack of a pantograph type constituted by combining the upper and the lower grooved links with the screw block in which the screw block having unidiameter inserts through an inserting hole formed on the two side wall portions of end portions of the upper and lower groove links to project the two end portion of screw block to outside of two side walls. In this state, a plurality of projections for stopping are formed by plastic procession with separating each other around axial periphery on the portions of screw block adjacent to inner and outer face of two side wall portions of the upper and lower grooved links respectively.

In accordance with the present invention, due to the projections for stopping, the two side walls of the end portions of the upper and lower grooved links are limited to move toward the axial direction of screw block, in this state, the jack is elevated and lowered by turning the screw around the periphery of axial of screw block.

DESCRIPTION OF A PREFERRED EMBODIMENT

Figure 1:
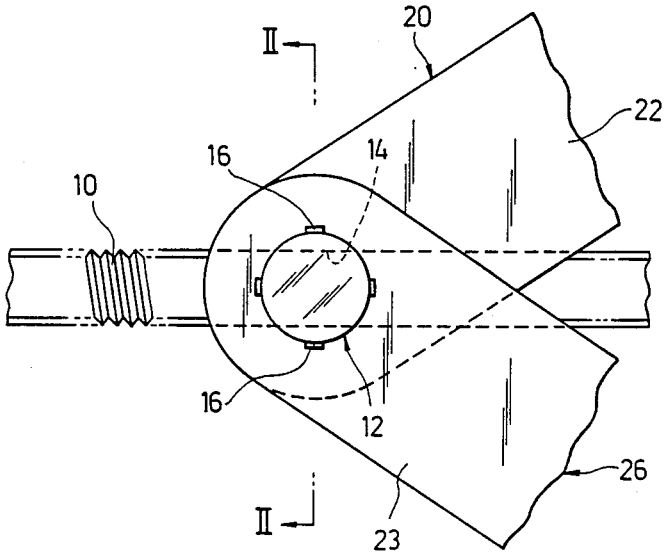
FIG. 1 is a sectional view of an important portion according to an embodiment of the present invention.
Figure 2:
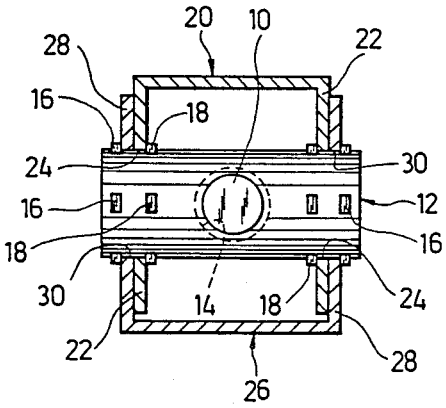
FIG. 2 is a side sectional view taken along the line II-II of FIG. 1.

In the present invention, such as shown in Figs, the screw block (12) made of a rod having unidiameter, for example, screw nut body having thread hole (14) engaged with the thread portion of screw (10), inserts into the inserting hole (24), (30) in the two side wall (22), (28) portions of end portions of a pair of upper and lower grooved links (20), (26) with its diameter slightly greater than the diameter of screw block (12), after the two end portions insert into the two side walls (22), (28) to project outwardly, with the pair of upper and lower grooved links, the projections (16) for outer stopping and the projections (18) for inner stopping are formed by press work with separating each other by 90 around axial periphery on two end portions of screw block (12) adjacent to the outside of two side walls (22) of lower grooved link (26) of outside position and to the inside of two side walls (22) of upper grooved link (20) of inside position respectively, and this can be performed by means of plastic processing.

In accordance with the present invention, there is no need to perform the other processing except the engaged hole on the screw block and the lately formed projection for stopping can be easily performed by plastic working such as press working etc., and therfore, the manufacturing cost is low. At the same time, the screw block is the rod with small section and can also ensure its strength, so it can reduce the cost and weight.

On the other hand, the two side walls of upper and lower grooved link can be prevented to move toward the axial direction of screw block by the projections for stopping, therefore, this invention possesses high secure effect.

What is claimed is:

1. A jack of the pantograph type comprising:
   - a first grooved link having a side wall and a hole in the side wall near one end of the link;
   - a second grooved link having a side wall and a hole in the side wall near one end of the link;
   - a cylindrical shaped screw block having a threaded hole therein, the screw block passing through the holes in the first and second grooved links so that the first and second grooved links can be pivotally rotated about the screw block;
   - a plurality of projections on the screw block to prevent movement of the first and second grooved links in an axial direction over the screw block; and
   - a screw in the threaded hole of the screw block.

2. A jack as claimed in claim 1 wherein the first and second grooved links are of generally U-shaped configuration having a base and two side walls extending therefrom, the first and second grooved links being mounted on the screw block in opposed relationship, the side walls of the first grooved link being located interiorally of the side walls of the second grooved link.

3. A jack as claimed in claim 1 wherein the plurality of projections comprise a pair of axially spaced inner projections and a pair of axially spaced outer projections, the side walls of the first and second grooved links being located interjacent the inner and outer projections.

4. A jack as claimed in claim 1 wherein the projections are formed of plastic materials.

5. A jack as claimed in claim 1 wherein the threaded hole is substantially normal to the axis of the screw block.

* * * * *

UNITED STATES PATENT AND TRADEMARK OFFICE

CERTIFICATE OF CORRECTION

PATENT NO. : 4,771,986

DATED : September 20, 1988

INVENTOR(S) : HAYATO NASU

It is certified that error appears in the above-identified patent and that said Letters Patent are hereby corrected as shown below:

Front Page, left-hand column, after "[73]

Assignee: Michael Hung", please insert

-- Part Interest --.

Signed and Sealed this

Eleventh Day of April, 1989

*Attest:*

*Attesting Officer*

DONALD J. QUIGG

*Commissioner of Patents and Trademarks*